US008641473B1

(12) United States Patent
Murray

(10) Patent No.: US 8,641,473 B1
(45) Date of Patent: Feb. 4, 2014

(54) CUSTOM MOTORCYCLE TOYS HAVING INTERCHANGEABLE SWING ARMS

(76) Inventor: Jeremiah Murray, Spindale, NC (US)

( * ) Notice: Subject to any disclaimer, the term of this patent is extended or adjusted under 35 U.S.C. 154(b) by 402 days.

(21) Appl. No.: 13/027,331

(22) Filed: Feb. 15, 2011

(51) Int. Cl.
*A63H 17/00* (2006.01)

(52) U.S. Cl.
USPC ..... 446/440; 446/95; 446/469

(58) Field of Classification Search
USPC ..... 446/440, 94, 95, 465, 469, 470
See application file for complete search history.

(56) References Cited

U.S. PATENT DOCUMENTS

| | | | | |
|---|---|---|---|---|
| 4,201,011 | A | 5/1980 | Cook | |
| 4,342,175 | A * | 8/1982 | Cernansky et al. | 446/440 |
| D267,101 | S | 11/1982 | Goldfarb | |
| 4,463,515 | A * | 8/1984 | Barlow et al. | 446/409 |
| 5,041,043 | A | 8/1991 | Hoke | |
| 5,489,232 | A | 2/1996 | Chang | |
| 6,350,171 | B1 | 2/2002 | Hippely | |
| 6,632,121 | B2 * | 10/2003 | Edmisson et al. | 446/471 |
| 7,234,990 | B2 * | 6/2007 | Leonov et al. | 446/440 |
| D591,205 | S | 4/2009 | Heinrich | |
| 7,717,767 | B2 * | 5/2010 | Amadio et al. | 446/95 |
| 2006/0046611 | A1 | 3/2006 | Rehkemper | |
| 2007/0202773 | A1 * | 8/2007 | Yuen | 446/94 |
| 2007/0264904 | A1 | 11/2007 | Sheltman | |
| 2008/0261488 | A1 * | 10/2008 | Jabbour et al. | 446/466 |
| 2011/0183577 | A1 * | 7/2011 | Chen | 446/456 |

* cited by examiner

*Primary Examiner* — Gene Kim
*Assistant Examiner* — Joseph B Baldori

(57) ABSTRACT

The custom motorcycle toys having interchangeable swing arms includes a series of toy motorcycles in which the rear end includes removable swing arms that can be exchanged with interchangeable rear tires so as to further customize the motorcycle. The front tire and rear tire can both rotate to enable movement of the toy motorcycle.

5 Claims, 5 Drawing Sheets

CUSTOM MOTORCYCLE TOYS HAVING INTERCHANGEABLE SWING ARMS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of motorcycle toys, more specifically, a series of custom motorcycles wherein interchangeable swing arms are included.

B. Discussion of the Prior Art

As a preliminary note, it should be stated that there is an ample amount of prior art that deals with motorcycle toys generally. As will be discussed immediately below, no prior art discloses a series of custom motorcycle toys that each include detachable swing arms and rear tires that enable the end user to further customize the motorcycle toy; wherein the rear tire can also be detached from the swing arm to interchange the swing arm with respect to the rear tire; and wherein both the front tire and the rear tire can rotate to simulate movement of the motorcycle toy.

The Sheltman et al. Patent Application Publication (U.S. Pub. No. 2007/0264904) discloses a toy motorcycle having a frame and front and rear wheels spinably coupled to the frame. However, the toy motorcycle does not have a plurality of swing arms and rear wheels to interchange in order to further customize said motorcycle.

The Rehkemper et al. Patent Application Publication (U.S. Pub. No. 2006/0046611) discloses a toy motorcycle having retractable appendages. However, the toy motorcycle does not include a plurality of swing arms and rear wheels to interchange, and customize the style of the toy motorcycle.

The Hippely et al. Patent (U.S. Pat. No. 6,350,171) discloses a toy motorcycle configurable into multiple formats. However, the toy motorcycle is not a series of toy motorcycles that having interchangeable swing arms and rear tires to customize.

The Cook Patent (U.S. Pat. No. 4,201,011) discloses a two wheeled flywheel powered toy motorcycles. However, the toy motorcycles do not have interchangeable swing arms and rear tires.

The Hoke Patent (U.S. Pat. No. 5,041,043) discloses an adjustable height motorcycle push toy. However, the push toy does not resemble a toy motorcycle that has a plurality of swing arms and interchangeable rear tires.

The Goldfarb et al. Patent (U.S. Pat. No. Des. 267,101) illustrates a design for a toy motorcycle, which does not depict interchangeable swing arms.

The Heinrich et al. Patent (U.S. Pat. No. Des. 591,205) illustrates a design for a motorcycle replica, which doe's not depict interchangeable swing arms.

The Chang Patent (U.S. Pat. No. 5,489,232) discloses a model motorcycle having adjustable parts. Again, the model motorcycle does not include a series of interchangeable swing arms as well as interchangeable rear tires.

While the above-described devices fulfill their respective and particular objects and requirements, they do not describe a series of custom motorcycle toys that each include detachable swing arms and rear tires that enable the end user to further customize the motorcycle toy; wherein the rear tire can also be detached from the swing arm to interchange the swing arm with respect to the rear tire; and wherein both the front tire and the rear tire can rotate to simulate movement of the motorcycle toy. In this regard, the custom motorcycle toys having interchangeable swing arms departs from the conventional concepts and designs of the prior art.

SUMMARY OF THE INVENTION

The custom motorcycle toys having interchangeable swing arms includes a series of toy motorcycles in which the rear end includes removable swing arms that can be exchanged with interchangeable rear tires so as to further customize the motorcycle. The front tire and rear tire can both rotate to enable movement of the toy motorcycle.

An object of the invention is to provide a kit including a series of at least one toy motorcycle in which a plurality of swing arms are provided to be interchanged with the rear end of the motorcycle to give different styles to the toy motorcycle.

A further object of the invention is to provide a kit including a plurality of rear tires that can be attached to the swing arms in order to further customize the rear end of the toy motorcycles.

A further object of the invention is to provide a kickstand that attaches onto a side of the toy motorcycle and of which will support the toy motorcycle when at rest.

A further object of the invention is to provide at least one screw that can secure the swing arm to the motorcycle.

A further object of the invention is to provide the kit with front tires and rear tires that can rotate to enable mobility of the toy motorcycle.

These together with additional objects, features and advantages of the custom motorcycle toys having interchangeable swing arms will be readily apparent to those of ordinary skill in the art upon reading the following detailed description of presently preferred, but nonetheless illustrative, embodiments of the custom motorcycle toys having interchangeable swing arms when taken in conjunction with the accompanying drawings.

In this respect, before explaining the current embodiments of the custom motorcycle toys having interchangeable swing arms in detail, it is to be understood that the custom motorcycle toys having interchangeable swing arms is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the custom motorcycle toys having interchangeable swing arms.

It is therefore important that the claims be regarded as including such equivalent construction insofar as they do not depart from the spirit and scope of the custom motorcycle toys having interchangeable swing arms. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
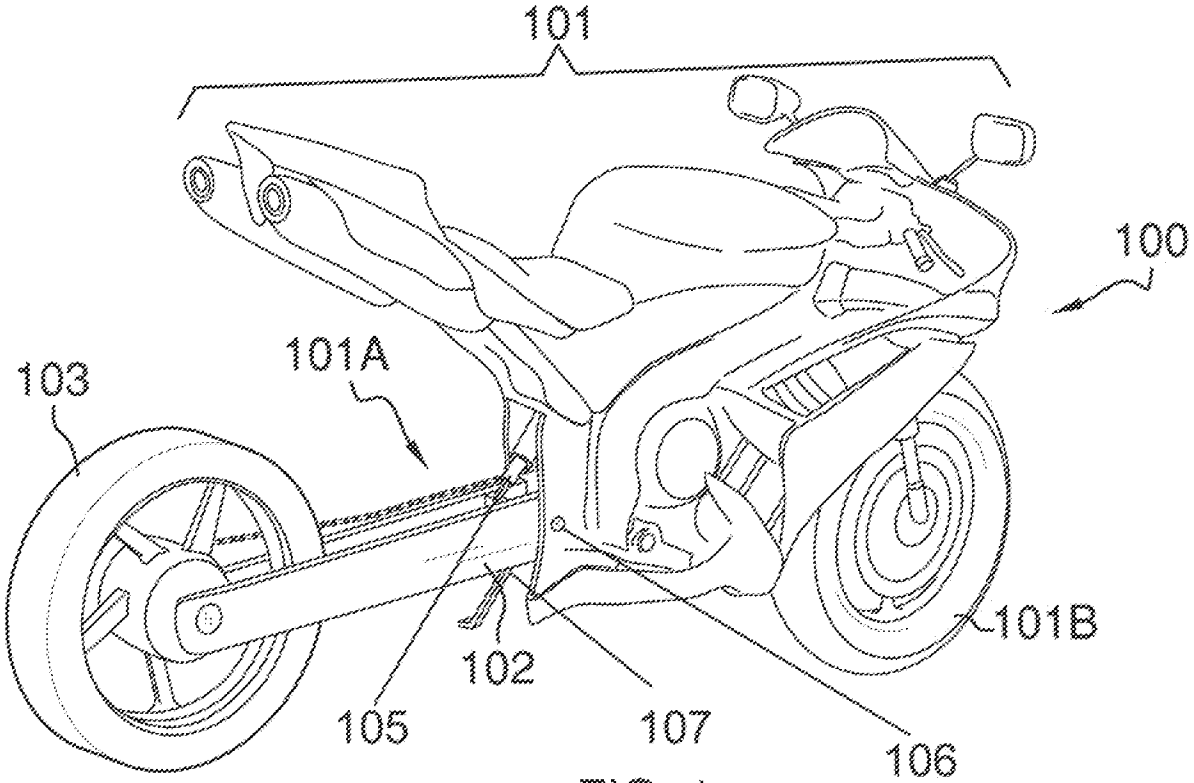
FIG. 1 illustrates a left, rear isometric view of a toy motorcycle with an attached swing arm and rear tire.
Figure 2:
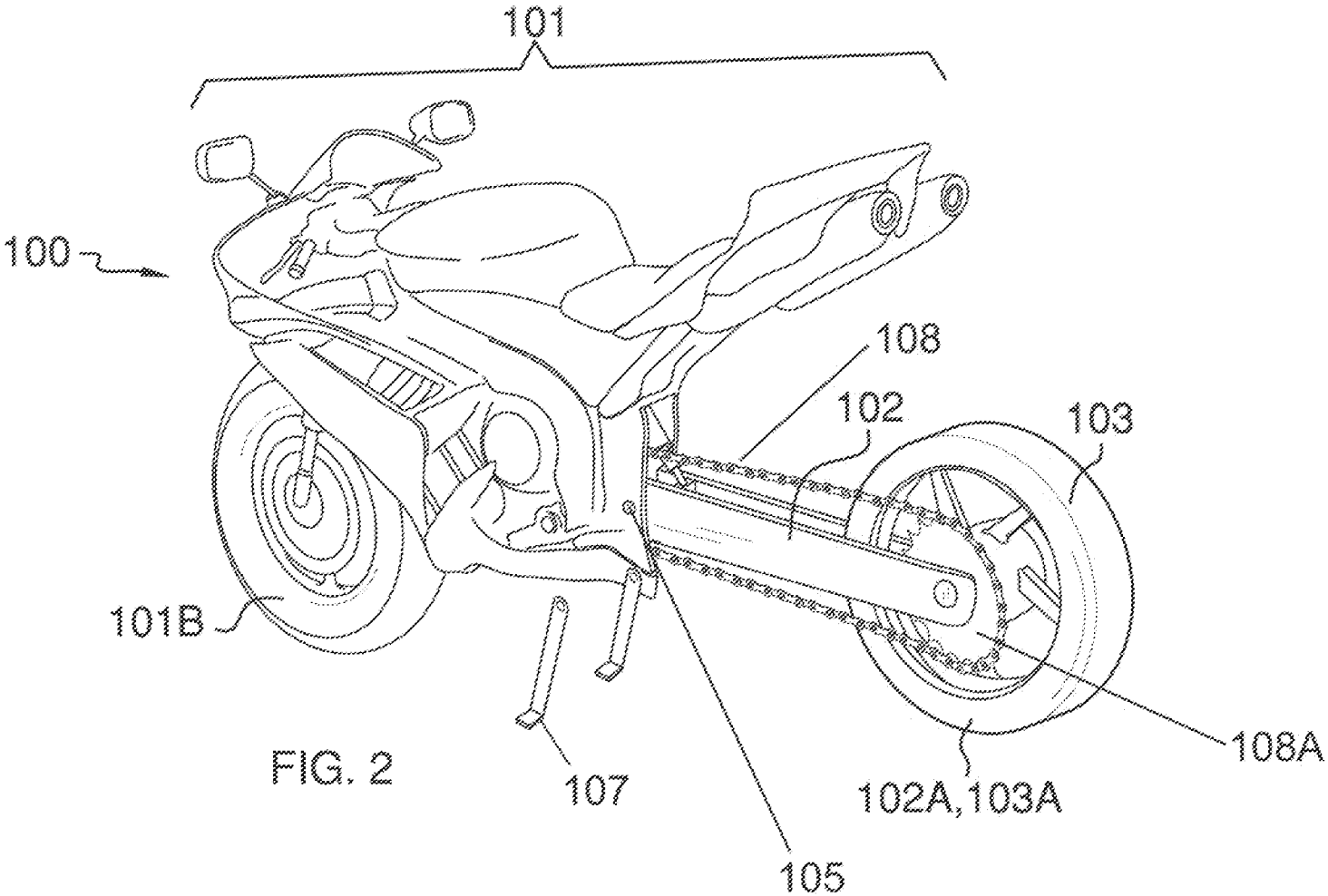
FIG. 2 illustrates a right, rear isometric view of the toy motorcycle of FIG. 1 in which a pair of kickstands are depicted, and one kickstand is actually secured to a side of the toy motorcycle.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A custom motorcycle toy having interchangeable swing arms 100 (hereinafter invention) includes a toy motorcycle 101 of a miniature size. The toy motorcycle 101 includes a rear end 101A into which a swing arm 102 attaches. The swing arm 102 attaches to the rear end 101A in order to enable attachment of one of a plurality of rear tire 103.

The swing arm 102 includes a pin 102A that extends from the swing arm 102 and onto which one of the rear tires 103 attaches. Each of the rear tires 103 includes a hole 103A onto which the pin 102A slides. Located at an end of the pin 102A is a spring-loaded nub 102B, which is used to secure the rear tire 103 onto the pin 102A.

The toy motorcycle 101 also features a front tire 101B, which can rotate with respect to the toy motorcycle 101. Coincidentally, the rear tires 103 can rotate with respect to the swing arm 102, thereby enabling mobility of the toy motorcycle 101.

Figure 5:
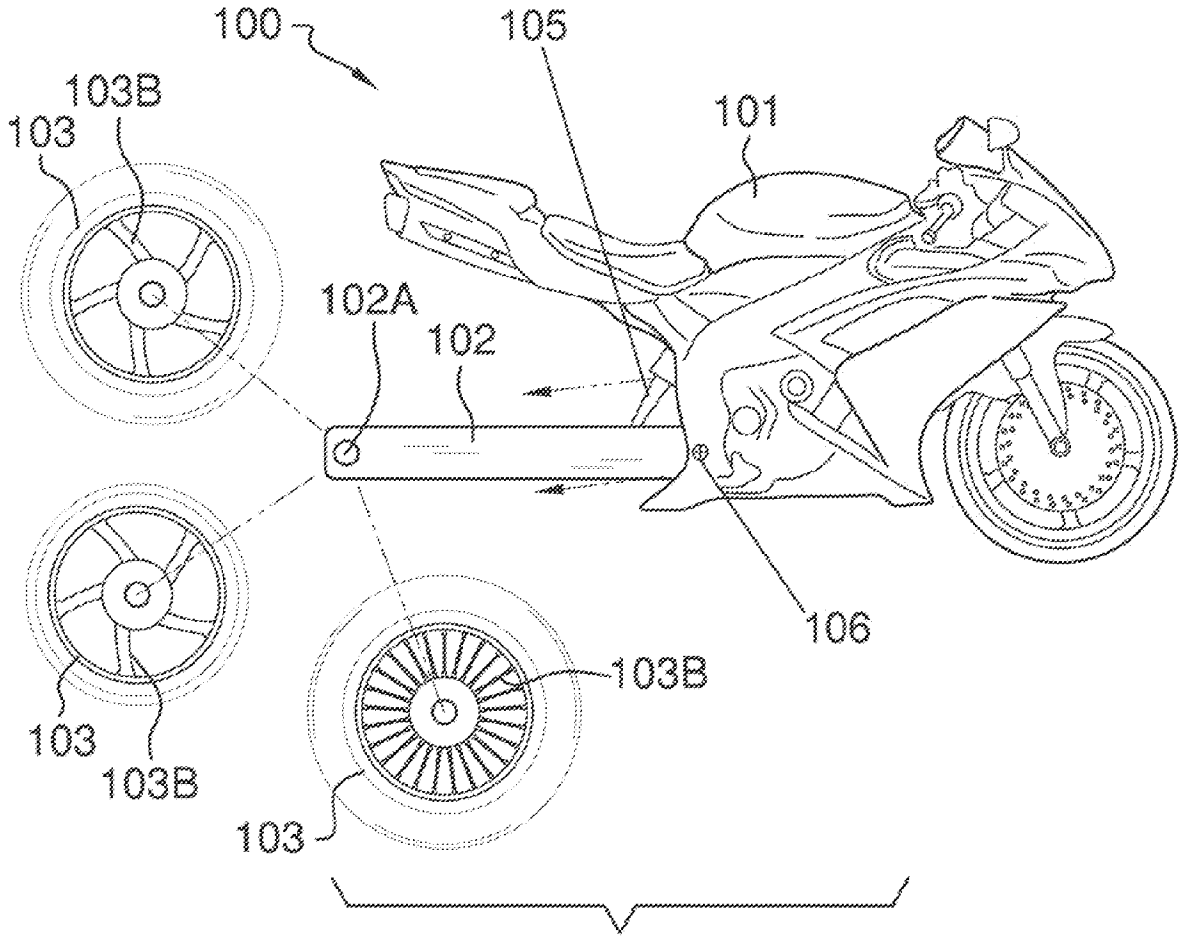
FIG. 5 illustrates a side set view of the toy motorcycle and a plurality of interchangeable tires, and wherein the swing arm can be detached by sliding backwards from a rear end of the toy motorcycle.

Referring to FIG. 5, the rear tires 103 may involve different sizes as is depicted. Furthermore, each rear tire 103 includes a rear wheel 103B of differing sizes and styles. The rear tires 103 are of different sizes and styles, and are interchangeable to provide customization of the invention 100.

Furthermore, it shall be noted that the front tire 101B may have a different style and shape when compared to the rear tire 103, which adds to the overall customizability of the invention 100.

Figure 4:
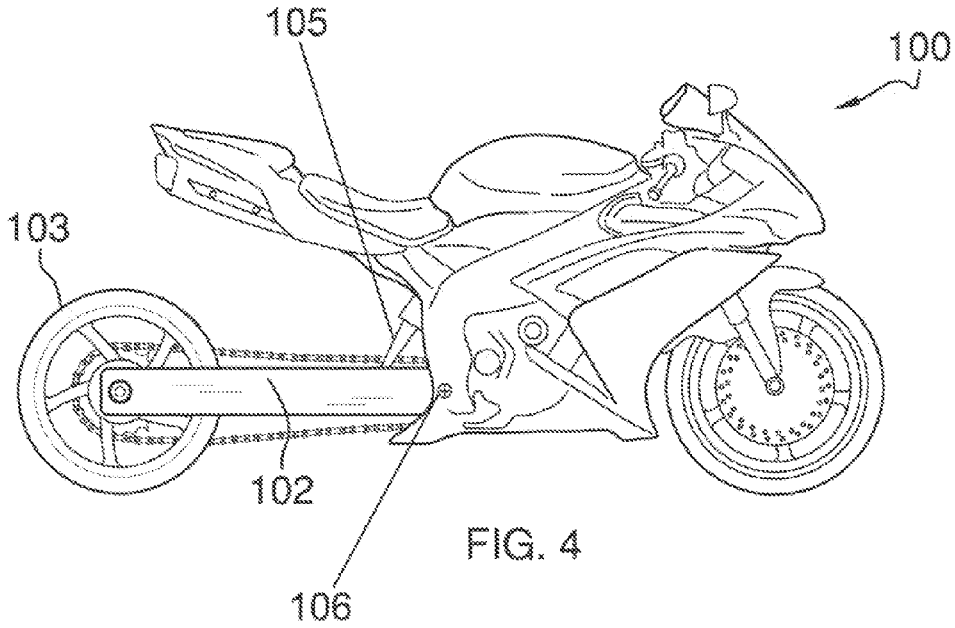
FIG. 4 illustrates a side view of the toy motorcycle with the same rear tire.
Figure 4A:
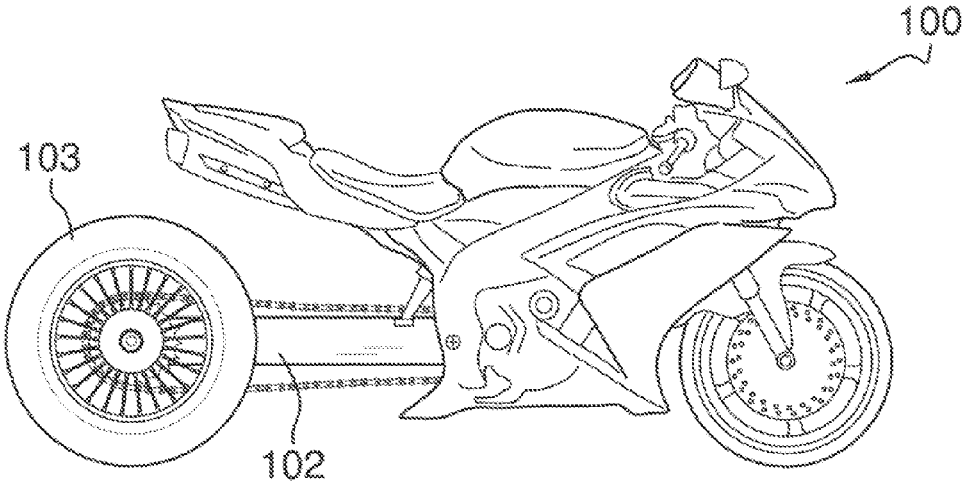
FIG. 4A illustrates the side view of FIG. 4, but with an optional left-sided swing arm in which the tire is secured to a right side of the swing arm.

Referring to FIGS. 4, 4A, and 5, the swing arm 102 may have different styles and shapes, which can add to the overall customizability of the invention 100. However, it shall be noted that the different styled swing arms 102 each include pins 102 having the spring-loaded nub 102B, which enable attachment of the rear tire 103 in consistency.

Comparing FIGS. 4 and 4A, the swing arm 102 may be left-sided or right sided in which the tire 103 attaches onto the left side or the right side. The orientation of the swing arm 102 relative the tires 103 is another feature that is unique to a customizable toy motorcycle.

A strut 105 is mounted to the rear end 101A of the motorcycle 101 and imposes a downward force onto the swing arm 102, which insure that the swing arm 102 does not rotate upward when attached to the motorcycle 101.

Figure 3:
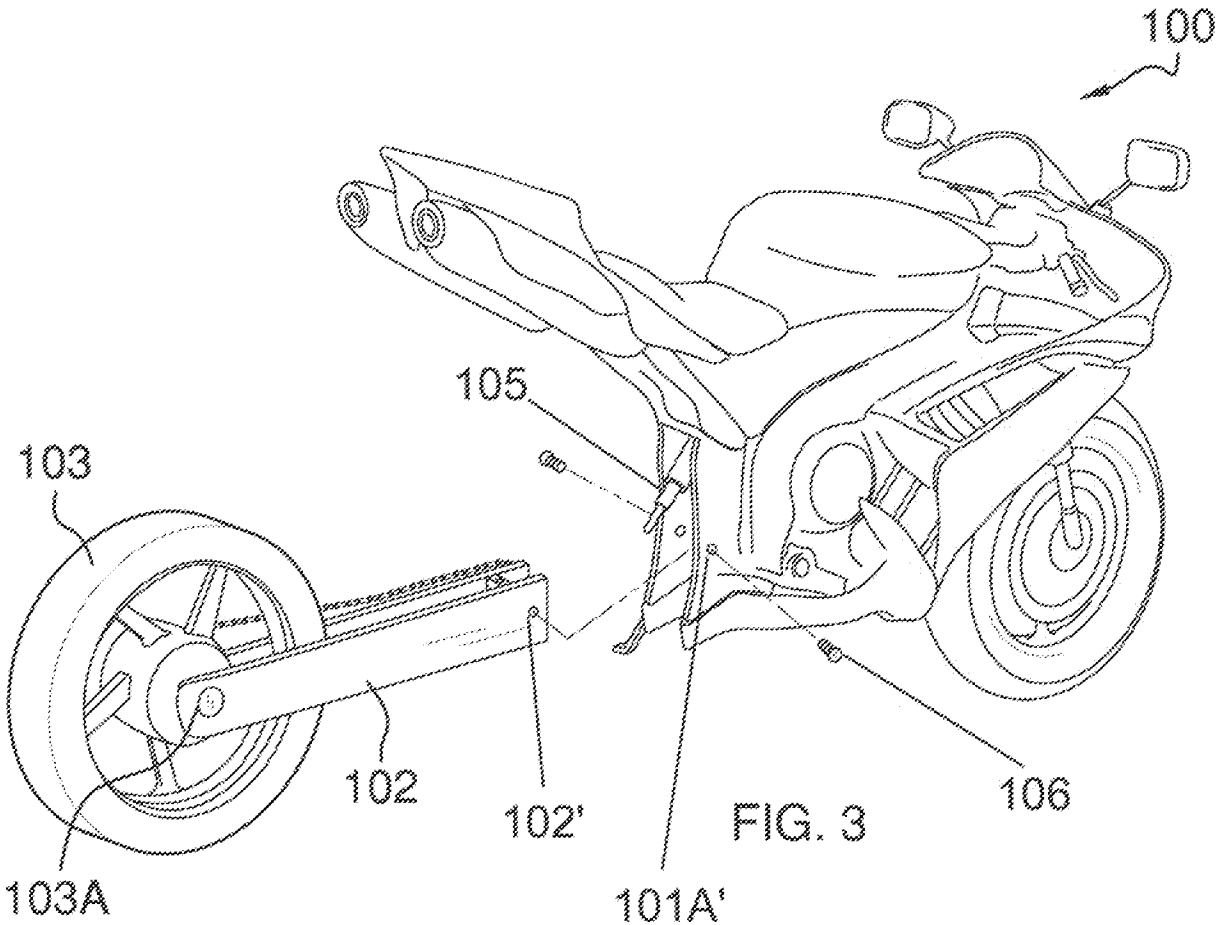
FIG. 3 illustrates a left, rear isometric view of the toy motorcycle of FIG. 1 wherein the rear tire is detached from the swing arm, the swing arm is detached from the motorcycle and corresponding screws are exploded therefrom.

The swing arm 102 attaches to the rear end 101A of the motorcycle 101 via at least one screw 106 that traverses through a hole 101A' located on the rear end 101A of the motorcycle 101, and into a hole 102' located on the swing arm 102 (referring to FIG. 3).

The invention 100 also includes a kickstand 107 that attaches onto a side of the motorcycle 101, and is rotatably engaged thereon. The kickstand 107 clips onto the side of the motorcycle 101, and is located on a side opposite of where the wheel 103 attaches onto the swing arm 103.

The invention 100 also includes a chain 108 that extends from the rear end 101A of the motorcycle 101 and around a sprocket 108A located at an end of the swing arm 102. The chain 108 is merely decorative, but gives the appearance of a real motorcycle.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A custom motorcycle toy having interchangeable swing arms comprising:

a toy motorcycle having a rear end into which a swing arm is attached;

wherein the swing arm includes a pin onto which a rear tire is attached;

wherein a front tire is located on the toy motorcycle;

wherein a plurality of rear tires are included and individually attach to the swing arm; and wherein the swing arm can attach the selected rear tire onto either the left side or right side of the motorcycle;

wherein the rear tires are of differing sizes;

wherein the rear tires include rear wheels of differing sizes and styles;

wherein the rear tires each include a hole into which a pin located on the swing arm is inserted in order to attach the selected rear tire thereon;

wherein both the rear tire and the front tire can rotate;

wherein the front tire has a different style and size with respect to the rear tires;

wherein the rear end of the motorcycle includes a strut that impacts upon the swing arm such that the swing arm, when attached to the rear end of the motorcycle shall not rotate there from.

2. The custom motorcycle toy as described in claim 1 wherein a kickstand attaches onto a side of the motorcycle opposite the side onto which the tire attaches to the swing arm.

3. The custom motorcycle toy as described in claim 1 wherein a chain extends from the rear end of the motorcycle and around a sprocket located at an end of the swing arm.

4. A custom motorcycle toy having interchangeable swing arms comprising:

a toy motorcycle having a rear end into which one of a plurality of swing arms is attached;

wherein the swing arm includes a pin;

wherein the a plurality of rear tires are included;

wherein the rear tires each include a hole into which the pin is inserted in order to attach the rear tire thereon;

wherein both the rear tire and the front tire can rotate;

wherein the front tire has a different style and size with respect to the rear tires;

wherein a front tire is located on the toy motorcycle;

wherein the plurality of rear tires attach to the swing arm;

wherein the swing arm can attach the selected rear tire onto either the left side or right side of the motorcycle;

wherein the rear tires are of differing sizes;

wherein the rear tires include rear wheels of differing sizes and styles;

wherein the swing arm attaches to the rear end of the motorcycle via at least one screw which passes through a hole in the swing arm and a hole located on the motorcycle;

wherein the rear end of the motorcycle includes a strut that impacts upon the swing arm such that the swing arm, when attached to the rear end of the motorcycle shall not rotate there from;

wherein a kickstand attaches onto a side of the motorcycle opposite the side onto which the tire attaches to the swing arm.

5. The custom motorcycle toy as described in claim 4 wherein a chain extends from the rear end of the motorcycle and around a sprocket located at an end of the swing arm.

* * * * *